US010944162B2

(12) United States Patent
Stein

(10) Patent No.: US 10,944,162 B2
(45) Date of Patent: Mar. 9, 2021

(54) PASSIVE SENSOR SYSTEM WITH CARBON NANOTUBE COMPONENTS

(71) Applicant: Analog Devices, Inc., Norwood, MA (US)

(72) Inventor: Yosef Stein, Sharon, MA (US)

(73) Assignee: Analog Devices, Inc., Wilmington, MA (US)

( * ) Notice: Subject to any disclaimer, the term of this patent is extended or adjusted under 35 U.S.C. 154(b) by 529 days.

(21) Appl. No.: 15/618,542

(22) Filed: Jun. 9, 2017

(65) Prior Publication Data

US 2017/0358854 A1 Dec. 14, 2017

Related U.S. Application Data

(60) Provisional application No. 62/348,657, filed on Jun. 10, 2016.

(51) Int. Cl.

| | |
|---|---|
| ***H01Q 1/36*** | (2006.01) |
| ***H01Q 1/38*** | (2006.01) |
| ***H01Q 1/24*** | (2006.01) |

(52) U.S. Cl.

CPC ..... *H01Q 1/368* (2013.01); *H01Q 1/248* (2013.01); *H01Q 1/36* (2013.01); *H01Q 1/38* (2013.01)

(58) Field of Classification Search

CPC ..... H01Q 1/368; H01Q 1/248

See application file for complete search history.

(56) References Cited

U.S. PATENT DOCUMENTS

| | | | | |
|---|---|---|---|---|
| 5,834,942 | A | 11/1998 | De Angelis | |
| 7,244,500 | B2 | 7/2007 | Watts et al. | |
| 7,398,184 | B1 | 7/2008 | Chen | |
| 8,378,757 | B2 * | 2/2013 | Shin | B82Y 30/00 331/154 |
| 8,552,597 | B2 | 10/2013 | Song et al. | |
| 8,830,037 | B2 * | 9/2014 | Burke | G06K 19/0717 340/10.4 |

(Continued)

FOREIGN PATENT DOCUMENTS

| | | |
|---|---|---|
| CA | 2 864 817 A1 | 8/2013 |
| EP | 3 190 421 A1 | 7/2017 |

(Continued)

OTHER PUBLICATIONS

International Preliminary Report on Patentability dated Dec. 20, 2018 in connection with International Application No. PCT/US2017/036719.

(Continued)

*Primary Examiner* — Dameon E Levi

*Assistant Examiner* — Jennifer F Hu

(74) *Attorney, Agent, or Firm* — Wolf, Greenfield & Sacks, P.C.

(57) ABSTRACT

A passive wireless sensor system is disclosed that includes components fabricated from carbon nanotube (CNT) structures. In some situations, the passive wireless sensor system includes a CNT structure sensor and an antenna that communicates wirelessly by altering an impedance of the antenna. The passive wireless sensor system includes a non-battery-powered energy storage device that harvests energy from carrier signals received at the antenna. The antenna and the energy storage device can be formed from CNT structures.

20 Claims, 6 Drawing Sheets

(56) References Cited

U.S. PATENT DOCUMENTS

| | | | | |
|---|---|---|---|---|
| 9,018,616 | B2 * | 4/2015 | Hanein | H01Q 9/285 257/9 |
| 9,091,657 | B2 | 7/2015 | Kessler et al. | |
| 9,232,475 | B2 | 1/2016 | Heinzelman et al. | |
| 9,372,209 | B2 | 6/2016 | Iwamoto | |
| 9,429,491 | B2 | 8/2016 | Bemis et al. | |
| 9,480,163 | B2 | 10/2016 | Kessler et al. | |
| 10,502,676 | B2 | 12/2019 | Kessler et al. | |
| 10,581,176 | B2 * | 3/2020 | Puchades | H01Q 1/368 |
| 2005/0183492 | A1 * | 8/2005 | Rao | G01H 13/00 73/24.06 |
| 2005/0269213 | A1 | 12/2005 | Steimle et al. | |
| 2006/0014155 | A1 * | 1/2006 | Hamers | B82Y 30/00 435/6.11 |
| 2006/0162431 | A1 | 7/2006 | Harris et al. | |
| 2007/0096565 | A1 * | 5/2007 | Breed | B60C 23/0408 307/116 |
| 2007/0120572 | A1 | 5/2007 | Chen et al. | |
| 2008/0135614 | A1 | 6/2008 | Werner et al. | |
| 2008/0202930 | A1 | 8/2008 | Mett | |
| 2008/0204275 | A1 | 8/2008 | Wavering et al. | |
| 2009/0039864 | A1 | 2/2009 | Gordon | |
| 2009/0121872 | A1 | 5/2009 | Lynch et al. | |
| 2010/0008825 | A1 | 1/2010 | Subramanyam | |
| 2010/0097273 | A1 * | 4/2010 | Biris | H01Q 1/38 343/700 R |
| 2010/0178543 | A1 * | 7/2010 | Gruner | H01G 11/68 429/121 |
| 2010/0320569 | A1 | 12/2010 | Narita | |
| 2011/0012723 | A1 * | 1/2011 | Adamson | B60C 23/0408 340/447 |
| 2011/0101996 | A1 * | 5/2011 | Potyrailo | G01D 21/00 324/655 |
| 2011/0240621 | A1 | 10/2011 | Kessler et al. | |
| 2012/0038377 | A1 | 2/2012 | Hamann et al. | |
| 2012/0055810 | A1 | 3/2012 | Zhou | |
| 2012/0256492 | A1 | 10/2012 | Song et al. | |
| 2012/0286804 | A1 | 11/2012 | Kato et al. | |
| 2013/0210154 | A1 | 8/2013 | Dieckhoff et al. | |
| 2013/0230429 | A1 | 9/2013 | Naishadham et al. | |
| 2014/0126442 | A1 | 5/2014 | Jafarian et al. | |
| 2014/0145826 | A1 * | 5/2014 | Conner | G06K 19/0716 340/10.1 |
| 2014/0184249 | A1 | 7/2014 | Saafi et al. | |
| 2014/0200538 | A1 * | 7/2014 | Euliano | G01N 27/121 604/361 |
| 2014/0254445 | A1 | 9/2014 | Heinzelman et al. | |
| 2015/0317896 | A1 | 11/2015 | Planton et al. | |
| 2015/0330212 | A1 | 11/2015 | Sassi et al. | |
| 2016/0007288 | A1 | 1/2016 | Samardzija et al. | |
| 2016/0050757 | A1 | 2/2016 | Diao et al. | |
| 2016/0196455 | A1 | 7/2016 | Gudan et al. | |
| 2016/0238547 | A1 | 8/2016 | Park et al. | |
| 2016/0254844 | A1 | 9/2016 | Hull et al. | |
| 2016/0302264 | A1 | 10/2016 | Kessler et al. | |
| 2017/0019954 | A1 | 1/2017 | Kessler et al. | |
| 2017/0237466 | A1 | 8/2017 | Carr | |
| 2018/0003615 | A1 * | 1/2018 | Kessler | G01N 27/04 |
| 2018/0139698 | A1 | 5/2018 | Quinlan et al. | |
| 2020/0309674 | A1 * | 10/2020 | Wardle | G01N 27/127 |

FOREIGN PATENT DOCUMENTS

| | | | | |
|---|---|---|---|---|
| KR | 10-0839226 | B1 | 6/2008 | |
| WO | WO 2006/137849 | A1 | 12/2006 | |
| WO | WO 2008/125878 | A1 | 10/2008 | |
| WO | WO-2017214488 | A1 * | 12/2017 | H01Q 1/368 |

OTHER PUBLICATIONS

International Preliminary Report on Patentability dated Jan. 10, 2019 in connection with International Application No. PCT/US2017/040356.

International Search Report and Written Opinion dated Sep. 25, 2017 in connection with International Application No. PCT/US2017/036719.

International Search Report and Written Opinion dated Oct. 24, 2017 in connection with International Application No. PCT/US2017/040356.

Kang et al., Structural Health Monitoring based on Electrical Impedance of a Carbon Nanotube Neuron. Key Engineering Materials. 2006;321-323:140-5.

Kang, Carbon Nanotube Smart Materials. Thesis submitted to the Division of Research and Advanced Studies of the University of Cincinnati. 2005; 170 pages.

Kessler, Structural Health Monitoring Capabilities. Metis Design Corporation. Powerpoint Presentation 2008, 42 pages.

Oh et al., A 116n W Multi-Band Wake-Up Receiver with 31-bit Correlator and Interference Rejection. Custom Integrated Circuits Conference (CICC), 2013 IEEE. 4 pages.

Roberts et al., A 236nW-56.5dBm-Sensitivity Bluetooth Low-Energy Wakeup Receiver with Energy Harvesting in 65nm CMOS. 2016 IEEE International Solid-State Circuits Conference. Digest of Technical Papers. 2016; pp. 450-451.

Rocheleau et al., MEMS-Based Tunable Channel-Selecting Super-Regenerative RF Transceivers. Berkeley Sensor & Actuator Center. University of California. Prepublication Data Sep. 2015; 2 pages.

Sample et al., Design of an RFID-Based Battery-Free Programmable Sensing Platform. IEEE Transactions on Instrumentation and Measurement. Nov. 2008;57(11):2608-15.

* cited by examiner

PASSIVE SENSOR SYSTEM WITH CARBON NANOTUBE COMPONENTS

RELATED APPLICATIONS

This Application claims priority under 35 U.S.C. § 119(e) to U.S. Provisional Application Ser. No. 62/348,657, filed Jun. 10, 2016, and entitled "PASSIVE SENSOR SYSTEM WITH CARBON NANOTUBE COMPONENTS" which is hereby incorporated herein by reference in its entirety.

FIELD OF THE DISCLOSURE

The present disclosure relates generally to passive wireless sensor systems capable of measuring environmental conditions.

BACKGROUND

Sensor systems are sometimes used for sensing various environmental conditions. Sometimes a sensor system communicates with an external device using a transceiver included in the sensor system. The sensor system uses an external or battery-powered energy source to operate the transceiver and/or other components of the system.

Inclusion of a battery-powered energy source and a transceiver results in a bulky sensor system that consumes high power, usually in the range of 1-10 milliwatts. Also, such a system cannot be readily deployed at certain locations/sites where smaller packaging is desirable.

SUMMARY OF THE DISCLOSURE

A passive wireless sensor system is disclosed that includes components fabricated from carbon nanotube (CNT) structures. In some situations, the passive wireless sensor system includes a CNT structure sensor and an antenna that communicates wirelessly by altering an impedance of the antenna. The passive wireless sensor system includes a non-battery-powered energy storage device that harvests energy from carrier signals received at the antenna. The antenna and the energy storage device can be formed from CNT structures.

In certain embodiments, an ultra-low power passive wireless sensor system is provided that comprises a carbon nanotube (CNT) structure sensor, and an antenna coupled to the CNT structure sensor and configured to receive sensed data from the CNT structure sensor and wirelessly transmit the sensed data by altering an impedance of the antenna.

In certain embodiments, a method of operating an ultra-low passive wireless sensor is provided that comprises generating, by a carbon nanotube (CNT) structure sensor, an output signal based on a sensed condition, and altering an impedance of an antenna coupled to the CNT structure sensor in accordance with the output signal to wirelessly communicate the output signal.

In certain embodiments, a passive wireless sensor apparatus is provided that comprises a carbon nanotube (CNT) structure sensor, and an antenna coupled to the CNT structure sensor, wherein the sensor and the antenna are implemented using different CNT layers of the CNT structure.

BRIEF DESCRIPTION OF THE DRAWINGS

Various aspects and embodiments of the application will be described with reference to the following figures. It should be appreciated that the figures are not necessarily drawn to scale. Items appearing in multiple figures are indicated by the same reference number in all the figures in which they appear.

DETAILED DESCRIPTION

The embodiments described herein set forth a passive wireless sensor system that is capable of sensing various environmental conditions. One or more components of the passive wireless sensor system can be fabricated from carbon nanotube (CNT) structures. Forming the components of the passive wireless sensor system from CNT structures facilitates achieving a small system or device size, for instance on the microscale or nanoscale. In some embodiments, a compact stand-alone sensor may be fully contained within a housing lacking external electrical connections, and thus may represent an example of a zero-pin sensor.

In at least some embodiments, the passive wireless sensor system is capable of communicating sensed data wirelessly via backscattering and can be constructed without a transceiver. In at least some embodiments, the passive wireless sensor system is capable of generating energy to power various components of the system and implement the backscattering, and can be constructed without a battery-powered energy source. By constructing the passive wireless sensor system without a transceiver and/or battery-powered energy source, the passive wireless sensor system can operate at substantially low power. For example, in some embodiments, the passive wireless sensor system may consume less than 50 μWatts in operation, or any value or range of values within that range.

The aspects and embodiments described above, as well as additional aspects and embodiments, are described further below. These aspects and/or embodiments may be used individually, all together, or in any combination of two or more, as the application is not limited in this respect.

Figure 1:
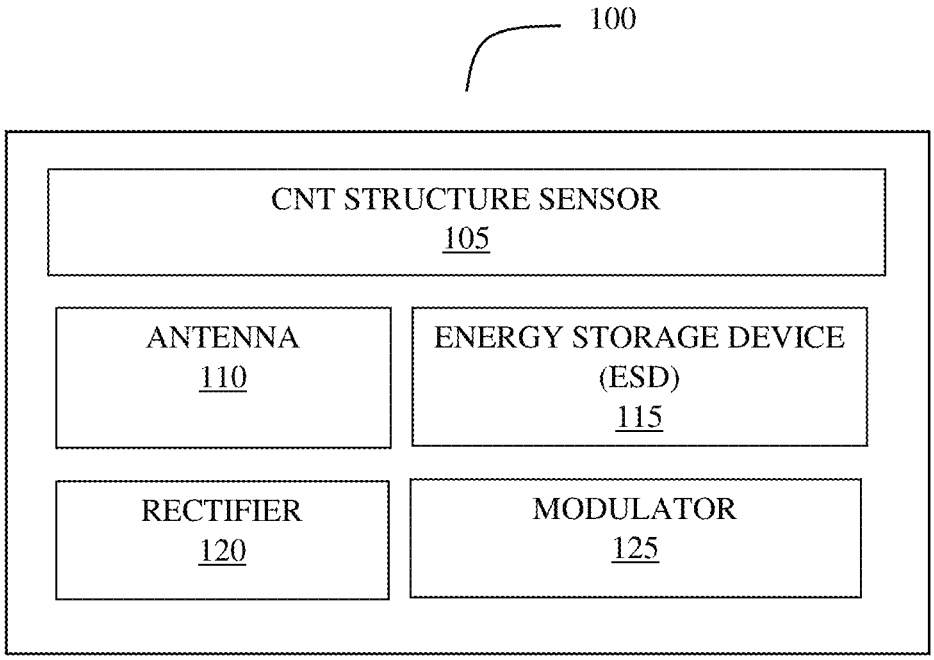
FIG. 1 illustrates a system architecture of a passive wireless sensor system, according to some embodiments.

FIG. 1 illustrates a passive wireless sensor system 100, according to an aspect of the disclosure. The passive wireless sensor system 100 includes a CNT structure sensor 105, an antenna 110, an energy storage device (ESD) 115, a rectifier 120, and a modulator 125.

Figure 5:
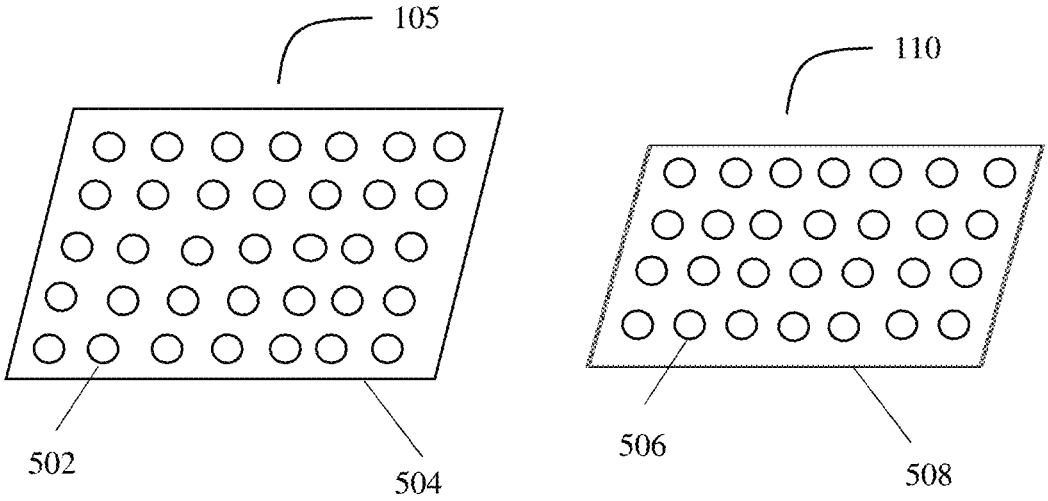
FIG. 5 depicts an exemplary sensor and antenna with vertically aligned carbon nanotube structures, according to one embodiment.

The CNT structure sensor 105 is formed from CNTs. In some embodiments, the CNT structure sensor 105 may be a vertically aligned CNT structure sensor. For example, as depicted in FIG. 5, a CNT structure sensor 105 may be formed from CNTs 502 oriented along their longitudinal axes normal to a substrate surface 504. At least some of the other components of the passive wireless sensor system 100 may also be fabricated from CNTs. In some embodiments, the antenna 110, the ESD 115, and the rectifier 120 are formed from CNTs. For example, FIG. 5 depicts a vertically aligned CNT structure antenna 110 formed from CNTs 506 oriented along their longitudinal axes normal to substrate surface 508. In some embodiments, the various components of the passive wireless sensor system 100 may be formed from a common piece of CNT nanostructured material, for example occupying different areas or vertical positions within the material. In some embodiments, the components may be formed at different levels of layers of the CNT structure and are vertically interconnected by CNTs. For example, the sensor 105 and the antenna 110 may be implemented using different CNT layers of the CNT structure. In other words, the sensor 105 and the antenna 110 depicted in FIG. 5 may be arranged in a layered configuration, where CNTs 502 and 506 may be aligned/interconnected with one another or with CNT layers associated other components of the passive wireless sensor system 100. In this manner, the CNT structure is used to interconnect different CNT layers (associated with the different components) to form a 3D sensor structure.

The antenna 110 may be formed from a CNT structure in some embodiments. The combination of the antenna 110 and modulator 125 may provide a variable impedance antenna allowing the passive wireless sensor system 100 to communicate wirelessly using backscattering. In some embodiments, the modulator 125 may be an impedance modulator that alters the impedance of the antenna 110 to implement the backscattering. Thus, the passive wireless sensor system 110 may lack a transceiver, and instead may use a received radio frequency (RF) signal, such as a 2.4 GHz continuous wave (CW) carrier signal. As such, the antenna 110 may be a 2.4 GHz antenna in some embodiments, although other frequencies may be used.

Because transceivers may consume a relatively large amount of power, constructing the passive wireless sensor system 100 without using a transceiver provides a meaningful reduction in power consumption of the system.

The ESD 115, in some embodiments, is a CNT-based ESD device. For example, ESD 115 may be a supercapacitor formed from a CNT structure. The ESD 115 harvests energy from the received carrier signal and stores the harvested energy. The rectifier 120 rectifies the received signal and may be formed from a CNT structure.

Figure 2:
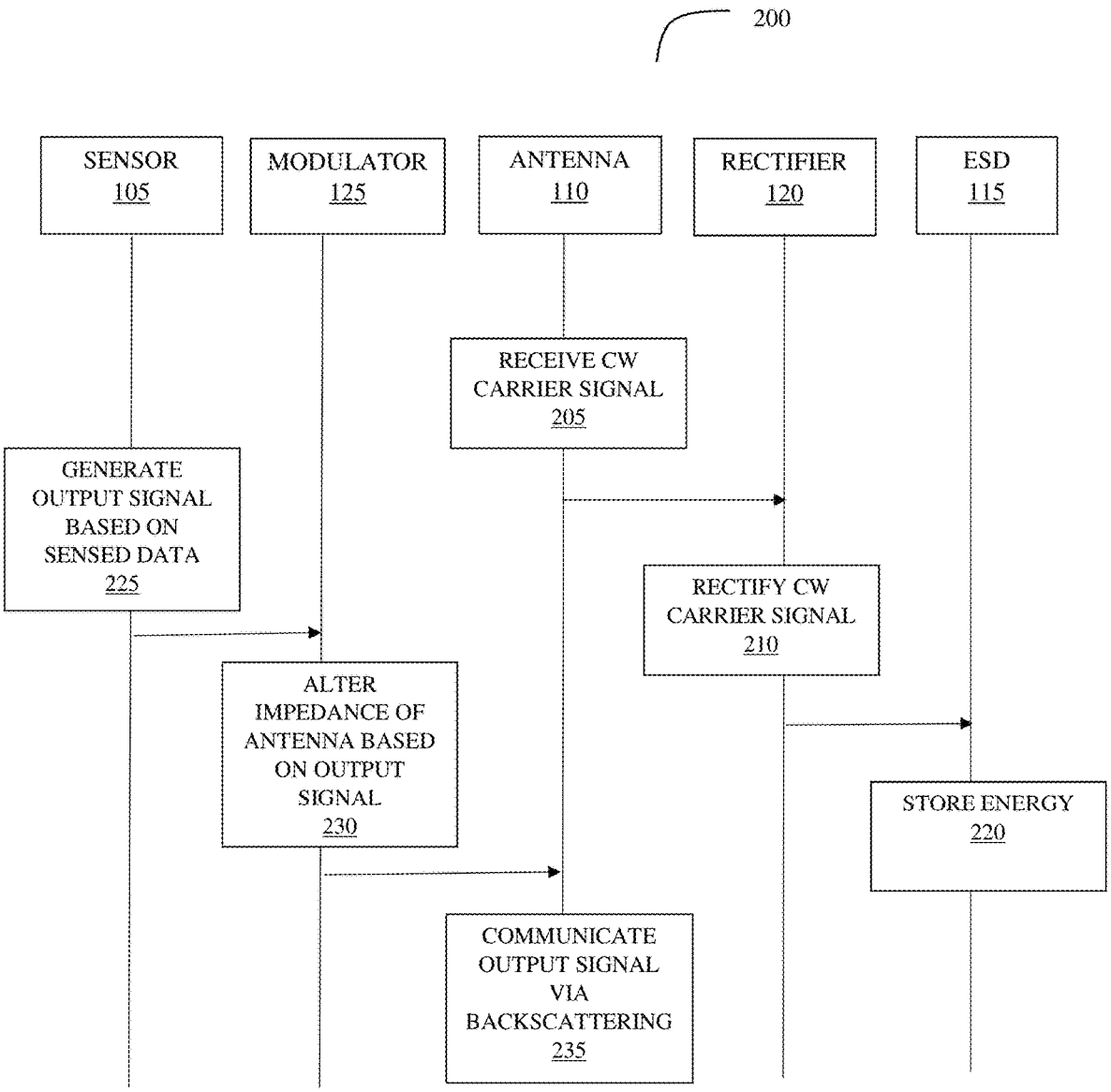
FIG. 2 illustrates a sequence diagram depicting interactions between different components of the passive wireless sensor system of FIG. 1, according to some embodiments.

FIG. 2 illustrates a sequence diagram 200 depicting interactions between various components of the passive wireless sensor system 100, according to some embodiments. At step 205, the antenna 110 receives a CW carrier signal from an external device (e.g., a reader, a host, a central module, etc.). At step 210, the received CW signal is rectified by the rectifier 120 and provided to the ESD 115. At step 220, energy is harvested from the signal and stored in the ESD 115.

At step 225, the sensor 105 may sense an environmental condition of interest and generate an output signal based on the sensed data. At step 230, the modulator 125 may alter the impedance of the antenna 110 based on the sensed data/output signal, thereby allowing the output signal to be communicated to the external device via backscattering of the received carrier signal, at step 235.

While FIG. 2 illustrates one manner of operation, alternatives are possible. Also, some of the illustrated steps may be combined or performed in a different order than that illustrated.

Figure 3:
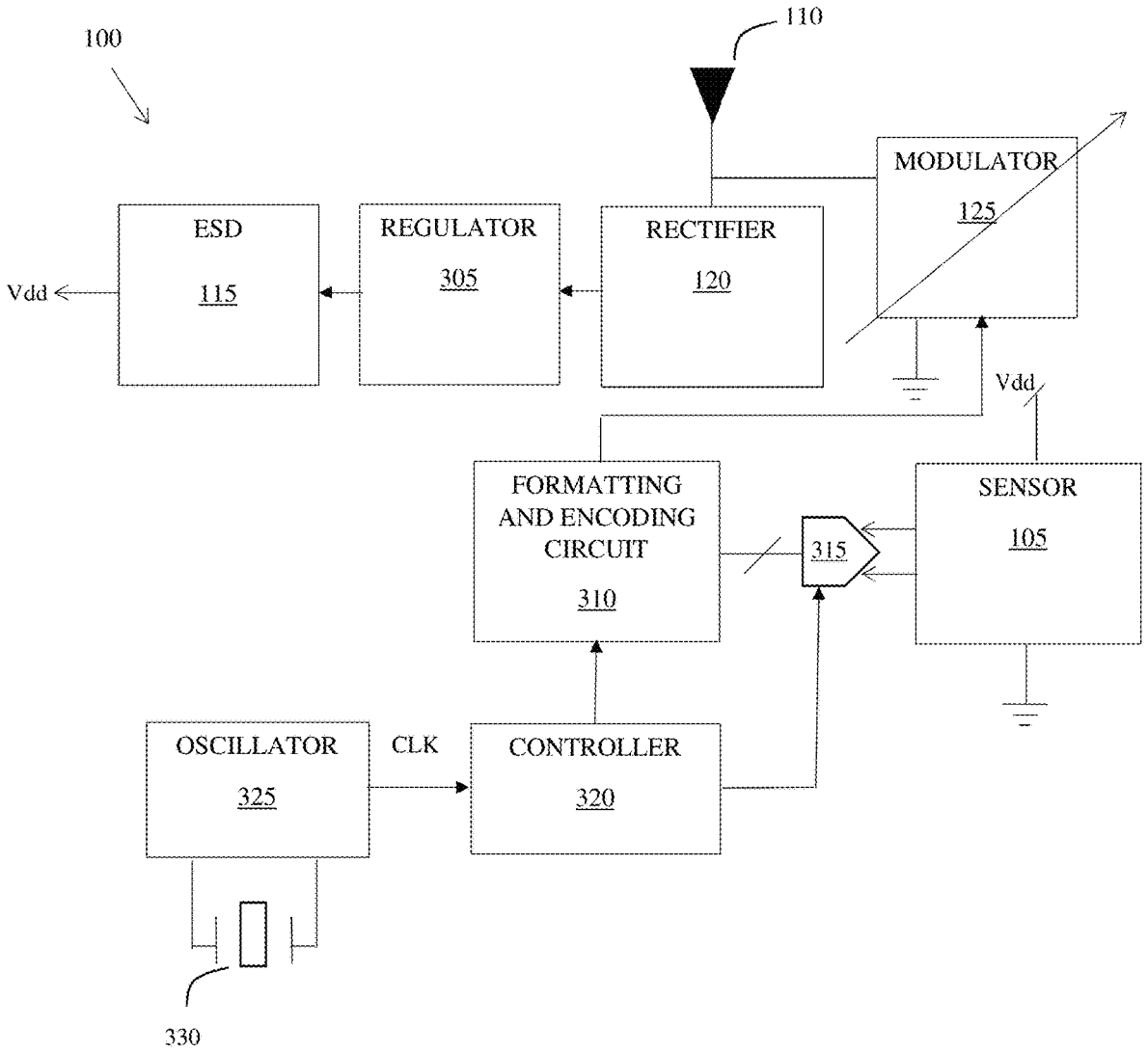
FIG. 3 illustrates a detailed block diagram of the different components of the passive wireless sensor system of FIG. 1, according to some embodiments.

FIG. 3 illustrates a detailed block diagram of the various components of the passive wireless sensor system 100, according to some embodiments. The passive wireless sensor system 100 includes the CNT structure sensor 105 (e.g., a vertically aligned CNT), the antenna 110, the ESD 115, the rectifier 120, the modulator 125, a regulator 305, a formatting and encoding circuit 310, an analog-to-digital converter (ADC) 315, a controller 320, an oscillator 325, and a resonator 330 (e.g., a crystal resonator).

The CNT structure sensor 105 may sense a characteristic or condition of interest without consuming power. For example, the sensor 105 may be a chemical-based sensor in which sensing is performed through chemical reactions, without requiring an external or battery-powered energy source. In some embodiments, the sensor 105 may be a corrosion sensor. In some embodiments, the sensor 105 may be a witness corrosion sensor, but may be other types of sensors. In some embodiments, the sensor 105 is coupled to the antenna 110, which is formed from a CNT structure.

In some embodiments, an output signal of the sensor 105 (including data sensed by the sensor 105) may be digitized by the ADC 315. The formatting and encoding circuit 310 may perform formatting and encoding functions. In some embodiments, the formatting and encoding circuit 310 may serialize the data, encode using Hamming encoding, and sequence frames to the transmitted. However, alternative or additional functions may be implemented.

In some embodiments, the controller 320 may be a digital sequencer with control logic, and may receive a clock signal from an oscillator 325 (e.g., a crystal oscillator) having a resonator 330 (e.g., a crystal resonator). The controller 320 may provide outputs to both the formatting and encoding circuit 310 and the ADC 315. In at least some embodiments, the controller 320 is not a processing core. In these embodiments, the controller 320 may be relatively simply, for example being a shift register with control logic. Such a construction may consume less power than a microprocessor core, facilitating low power operation of the passive wireless sensor system 100.

In some embodiments, the digitized output signal may be used to control the modulator 125, which is coupled to the antenna 110. The modulator 125 alters the impedance of the antenna 110 to implement backscattering of a received carrier signal, thus transmitting the sensed data from the passive wireless sensor system 100 to an external device.

The ESD 115 may be coupled to the antenna 110. In some embodiments, the ESD 115 is coupled to the antenna 110 via the rectifier 120 and the regulator 305. In some embodiments, the rectifier is coupled to the antenna 110 and is implemented as a CNT-based RF-to-DC rectifier, which converts RF signals to direct current (DC) voltage. The regulator 305 may be any suitable type of regulator as the various aspects described herein are not limited to use with a particular type of regulator. In some embodiments, the regulator may be formed from CNT structures.

In some embodiments, the antenna 110 may receive the carrier signal from the external device. For example, a 2.4 GHz CW signal may be received. The rectifier 120 rectifies the signal, which is boosted or otherwise regulated by the regulator 305, and is provided to the ESD 115. In some embodiments, additional energy harvesters may be provided, such as vibrational and thermoelectric harvesters. Such harvesters may be formed from CNT structures in some embodiments.

In some embodiments, the passive wireless sensor system 100 may comprise a mix of CNT and non-CNT components. For example, the sensor 105, the antenna 110, and the ESD 115 may be formed from CNT structures, and the controller 320, the formatting and encoding circuit, and/or other components may be formed from non-CNT structures/materials.

It will be appreciated that the other combinations or mixes of CNT and non-CNT components can be used to design the passive wireless sensor system 100 without departing from the scope of this disclosure.

Figure 4:
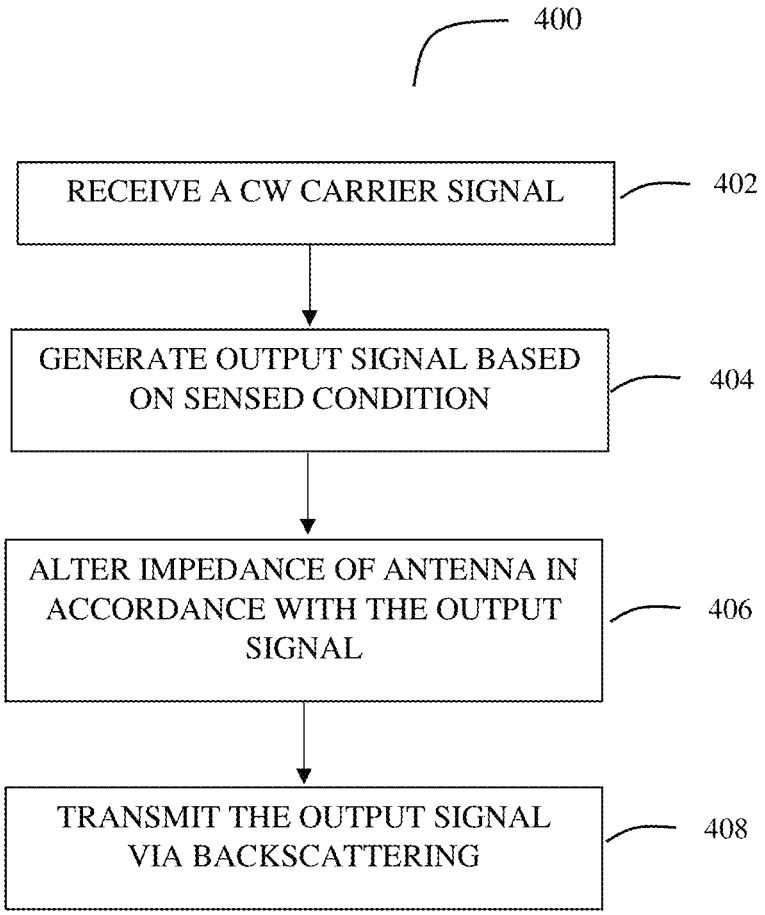
FIG. 4 illustrates a flowchart describing a method of operation of the different components of the passive wireless sensor system of FIG. 1, according to some embodiments.

FIG. 4 illustrates a flowchart 400 describing a method carried out by the different components of the passive wireless sensor system 100, according to some embodiments. At step 402, a continuous wave (CW) carrier signal (e.g., a radiofrequency (RF) CW signal) is received at the antenna 110. At step 404, the sensor 105 generates an output signal based on a sensed condition (e.g., corrosion). The output signal can include data associated with the sensed condition. At step 406, the modulator 125 alters the impedance of the antenna 110 in accordance with the output signal (i.e., sensed data associated with the output signal). At step 408, the antenna 110 transmits the output signal via backscattering of the received CW carrier signal.

In some embodiments, the CW carrier signal received at the antenna 110 is rectified by the rectifier 120 and provided to the ESD 115, which stores the energy harvested from the carrier signal.

In some embodiments, the passive wireless sensor system 100 may be packaged within a plastic package or other material. In some embodiments, the passive wireless sensor system 100 may be packaged in a package lacking external electrical circuits, contacts or connections, such as pins. Thus, the passive wireless sensor system, in at least some embodiments, is a CNT-based passive zero-pin sensor.

Figure 6:
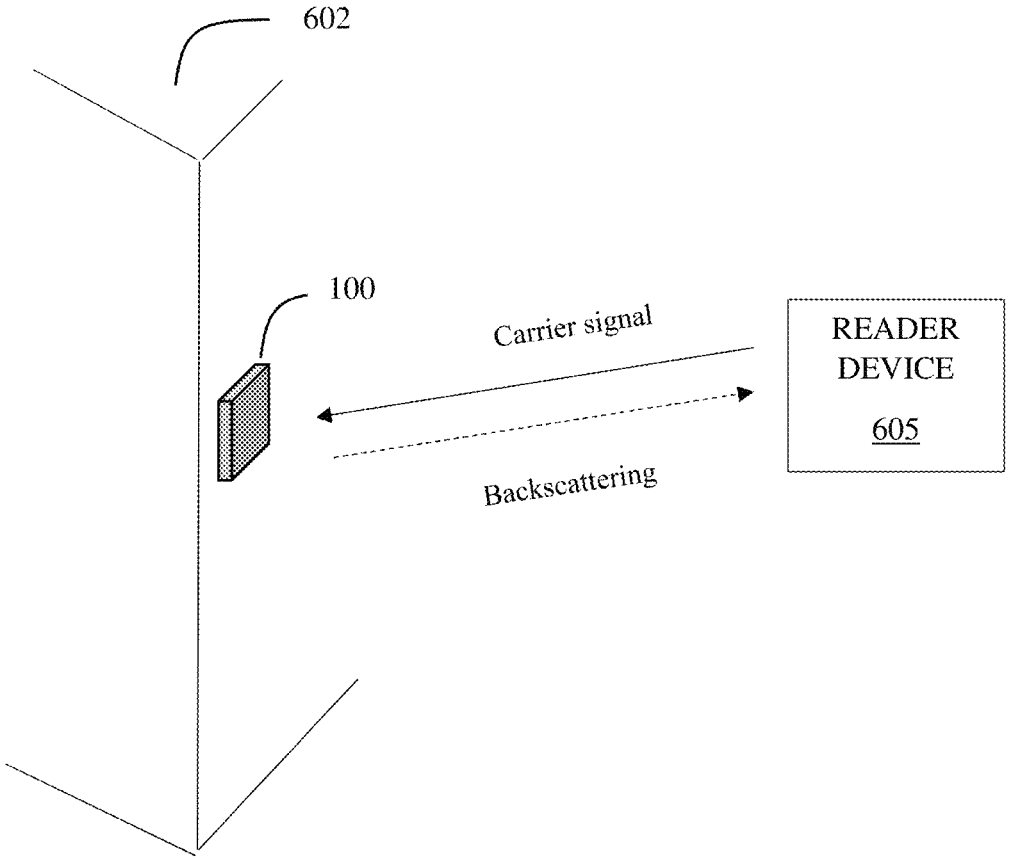
FIG. 6 depicts the passive wireless sensor system of FIG. 1 attached to an environmental component and used for sensing an environmental condition, according to some embodiments.

In some embodiments, as depicted in FIG. 6, the passive wireless sensor system 100 may be disposed in an environment of interest to sense a condition of interest. For example, the system 100 may be attached, mounted to, or placed near, an environmental component 602 (e.g., a wall, building, or other component). A condition of the component or the surrounding environment may be monitored using the system 100. It will be appreciated that while the passive wireless sensor system 100 is depicted as having a rectangular shape, other shapes can be implemented without departing from the scope of this disclosure.

The passive wireless sensor system 100, in particular, antenna 110 of the passive wireless sensor system 100, receives a CW carrier signal from an external reader device 605. The antenna 110 transmits an output signal associated with a sensed condition of the environmental component 602 to the external reader device 605 via backscattering of the received CW carrier signal. The passive wireless sensor system 100 is powered by energy harvested from the received carrier signal and stored at the ESD 115.

In some embodiments, the CNT structure sensor 105 of the system 100 senses the condition of interest (e.g., corrosion of the environmental component) without consuming power. Thus, in some embodiments, power is used by the system 100 upon transmitting the output signal, or data based on such a signal, from the passive wireless sensor system 100.

In some embodiments, the antenna 110 of the passive wireless sensor system 100 may be flexible, allowing it to conform to any environmental component/structure on which the passive wireless sensor system 100 is placed. For example, the passive wireless sensor system 100 may be placed on a motor shaft, and the antenna 110 may conform to the shaft.

The terms "approximately", "substantially," and "about" may be used to mean within ±20% of a target value in some embodiments, within ±10% of a target value in some embodiments, within ±5% of a target value in some embodiments, and yet within ±2% of a target value in some embodiments. The terms "approximately" and "about" may include the target value.

What is claimed is:

1. An ultra-low power passive wireless sensor system, comprising:

a carbon nanotube (CNT) structure sensor;

an antenna coupled to the CNT structure sensor, wherein the CNT structure sensor and the antenna are implemented using different CNT layers, and wherein the antenna is configured to:

receive a continuous wave (CW) carrier signal, and receive sensed data from the CNT structure sensor and wirelessly transmit the sensed data by altering an impedance of the antenna; and a modulator configured to alter the impedance of the antenna based on the sensed data to implement backscattering of the CW carrier signal received by the antenna.

2. The ultra-low power passive wireless sensor system of claim 1, further comprising an energy storage device coupled to the antenna and configured to store energy harvested from the CW carrier signal received by the antenna.

3. The ultra-low power passive wireless sensor system of claim 2, wherein the energy storage device comprises a CNT structure.

4. The ultra-low power passive wireless sensor system of claim 1, further comprising a rectifier coupled to the antenna, wherein the rectifier comprises a CNT structure.

5. The ultra-low power passive wireless sensor system of claim 1, wherein the CNT structure sensor comprises a corrosion sensor.

6. The ultra-low power passive wireless sensor system of claim 1, wherein the antenna comprises a CNT structure.

7. The ultra-low power passive wireless sensor system of claim 1, wherein the CNT structure sensor is a vertically aligned CNT structure sensor.

8. The ultra-low power passive wireless sensor system of claim 1, further comprising at least one non-CNT component.

9. The ultra-low power passive wireless sensor system of claim 1, wherein the antenna is flexible and is configured to conform to a structure on which the sensor system is placed.

10. A method of operating an ultra-low power passive wireless sensor, comprising:

generating, by a carbon nanotube (CNT) structure sensor, an output signal based on a sensed condition, wherein the CNT structure sensor is implemented using a first CNT layer;

receiving, by an antenna coupled to the CNT structure sensor, a continuous wave (CW) carrier signal, wherein the antenna is implemented using a second CNT layer different from the first CNT layer; and altering an impedance of the antenna coupled to the CNT structure sensor in accordance with the output signal to wirelessly communicate the output signal via backscattering of the CW carrier signal received by the antenna.

11. The method of claim 10, further comprising:

harvesting energy from the CW carrier signal; and storing the harvested energy in an energy storage device of the passive wireless sensor, wherein the energy storage device comprises a CNT structure.

12. The method of claim 10, wherein the CNT structure sensor comprises a vertically aligned CNT structure sensor.

13. The method of claim 10, wherein the antenna comprises a CNT structure.

14. A passive wireless sensor apparatus, comprising:

a carbon nanotube (CNT) structure sensor;

an antenna coupled to the CNT structure sensor and configured to wirelessly transmit data sensed by the CNT structure sensor by altering an impedance of the antenna; and a modulator configured to alter the impedance of the antenna based on the sensed data to implement backscattering of a continuous wave (CW) carrier signal received by the antenna, wherein the CNT structure sensor and the antenna are arranged in a layered configuration and implemented using different CNT layers of the layered configuration.

15. The passive wireless sensor apparatus of claim 14, wherein the CNT structure sensor comprises a corrosion sensor.

16. The passive wireless sensor apparatus of claim 14, wherein the CNT structure sensor, the antenna, and the modulator are packaged within a package lacking external electrical connections.

17. The passive wireless sensor apparatus of claim 14, wherein the CNT structure sensor is a vertically aligned CNT structure sensor.

18. The passive wireless sensor apparatus of claim 14, further comprising an energy storage device coupled to the antenna and comprising a CNT structure.

19. The passive wireless sensor apparatus of claim 14, further comprising at least one non-CNT component.

20. The passive wireless sensor apparatus of claim 14, wherein the different CNT layers are vertically aligned in the layered configuration.

* * * * *